US006390997B1

(12) United States Patent
Vitko

(10) Patent No.: US 6,390,997 B1
(45) Date of Patent: May 21, 2002

(54) BACK STIMULATOR AND REHABILITATION APPARATUS

(76) Inventor: David M. Vitko, 973 Fairfield Ave., Columbiana, OH (US) 44408

( * ) Notice: Subject to any disclaimer, the term of this patent is extended or adjusted under 35 U.S.C. 154(b) by 0 days.

(21) Appl. No.: 09/408,796

(22) Filed: Sep. 30, 1999

Related U.S. Application Data

(60) Provisional application No. 60/102,892, filed on Oct. 2, 1998.

(51) Int. Cl.[7] ..... A61H 15/00

(52) U.S. Cl. ..... 601/115; 601/116; 601/128; 601/98; 601/99

(58) Field of Search ..... 601/97, 98, 99, 601/195, 116, 122, 128, 131

(56) References Cited

U.S. PATENT DOCUMENTS 3,853,350 A * 12/1974 Leffler ..... 297/404
4,688,556 A 8/1987 Keller
4,796,616 A 1/1989 Panahpour
5,352,188 A 10/1994 Vitko
5,387,181 A * 2/1995 Olsen ..... 601/155
5,634,887 A * 6/1997 Fortier ..... 601/115
5,772,614 A * 6/1998 Lindquist ..... 601/116

* cited by examiner

*Primary Examiner*—Michael A. Brown
*Assistant Examiner*—Benjamin K. Koo
(74) *Attorney, Agent, or Firm*—Christopher L. Parmelee; Walker & Jocke LPA

(57) ABSTRACT

A small lightweight yet strong frame (12) housing multiple flexible axles (22) which in turn support foam rubber roller balls (16), which roll about an axis creating: massage, intersegmental traction, trigger point therapy, and active exercise to the back of the user. These axles (22) are made more efficient by the placement of bushings (26) where they are contained by frame (12). Foam rubber balls (16) contain sleeves (30) which promote free rotation. A sliding head rest (38) is provided for comfort and is also used to facilitate optional concomitant neck and back treatment and multiple tension adjustments (46) (36) are provided for varying resistance to glide.

17 Claims, 7 Drawing Sheets

BACK STIMULATOR AND REHABILITATION APPARATUS

This application claims benefit of U.S. Provisional Application Serial No. 60/102,892 filed Oct. 2, 1998.

TECHNICAL FIELD

This invention relates to a combined back massage, intersegmental traction, trigger point stimulation, and active rehabilitation device. More specifically this invention relates to a new back stimulation device which is self administered, portable, compact, economically built, and comfortable to use.

BACKGROUND ART

Chiropractors, physical therapists, and massage therapists have long recognized the benefits of intersegmental traction, trigger point stimulation, massage, and active muscle rehabilitation in treating various back and neck related problems. Although these treatments are known to be highly effective in pain relief, they can be very expensive. These forms of treatment are of a therapeutic nature, and therefore require a multitude of visits to health care providers. It is also difficult to make patients comply with suggested exercises for rehabilitation, as a means of prophylaxis.

Intersegmental traction refers to the slight mobilization of one joint relative to the next, in the spine for instance. Trigger point stimulation refers to the goading or rubbing of specific reflex points on the body. Many of these which are present in back and neck muscles are keys to relaxing muscles.

The incidence of back and neck pain is rising significantly around the world. In the United States alone an estimated 80 million Americans suffer from back pain. In response to the obvious need to quell this epidemic in which millions of dollars in worker productivity are lost weekly, this invention was conceived. It has the potential to greatly reduce the incidence and severity of back and neck disability. This invention successfully combines back massage with intersegmental traction, widespread trigger point therapy, and muscle rehabilitation in one cost effective device.

Historically many devices have been attempted for the purpose of either strengthening the back, the neck, or for the mere purpose of administering a good massage. Some inventions were meant to produce only focal stimulation of trigger points within the muscles. A few devices were nearly successful in performing multiple functions, but in reality the designs either caused major functional flaws, or the cost of manufacture was prohibitive to widespread use.

My Combined Back And Neck Stimulator And Rehabilitation Device, U.S. Pat. No. 5,352,188 combines back massage with a neck massage. The neck massage is provided by neck roller balls. However, drawbacks of this device include discomfort for users, leading to discontinuance of therapy and dissatisfaction with the device.

Other known prior art does not include devices that combine intersegmental traction, trigger point stimulation, massage, and active muscle rehabilitation in treating various back and neck related problems. There does exist however some prior art with scattered similarities in structure. One such device incorporates the use of foam rubber balls mounted directly on axles, with no means of preventing unavoidable erosion of the core matrix of the ball, or to provide for free and smooth rotation while the user rolls across the balls as a massage. When these aspects are considered, as in U.S. Pat. No. 4,796,616 (Panahpour, 1989) smooth operation and practicality are lost as a result of the design. A few inventions made use of rigid axles upon which the roller device was mounted. These often call for the inclusion of journaled attachment to the supportive frame however, which necessarily increases the cost of production as well as the weight of the device. U.S. Pat. No. 4,688,556 (Keller, Jr. 1987) suggested a support frame holding oblate spheroids. These were only effective at mobilizing the vertebra themselves however, since the friction was centrally focused by the shape of the rollers. It failed to produce trigger point therapy and was not practical for neck treatment. All known prior art that is similar in function has significant drawbacks, making each impractical for widespread use or production.

The following reasons are given for the failure of previous inventions to meet the obvious need which exists in this field:

a) previous inventions lacked smooth operation when design was applied to function b) previous inventions were too heavy for practical home application, especially motorized models c) previous inventions involved the use of special parts or difficult manufacture, therefore making cost impractical d) previous inventions lacked durability by design e) previous products lacked the versatility to treat multiple parts of the body simultaneously if so desired f) previous inventions required the assistance of a skilled practitioner for use g) previous inventions were uncomfortable to use.

Not all of these problems apply to every prior invention in this field. However, overall, there exits a need for a device that combines back massage, intersegmental traction, trigger point stimulation, and active rehabilitation in a apparatus that maximizes the comfort of the user and is relatively easy to use.

DISCLOSURE OF INVENTION

It is an object of the present invention to provide an apparatus that when properly used. will produce the combined effects of back stimulation or massage, widespread trigger point therapy, intersegmental traction, and active rehabilitation.

It is a further object of the present invention to provide a back stimulation apparatus that can be produced relatively cheaply to insure more widespread availability at an affordable price.

It is a further object of the present invention to provide a back stimulation apparatus that when properly used, will alleviate back and neck pain, and also help to prevent return of such symptoms in the regular user.

It is a further object of the present invention to provide a back stimulation apparatus that will have a long useful life by virtue of the design and durable construction.

It is a further object of the present invention to provide a back stimulation apparatus that is light weight, portable, and compact enough to be easily stored away in small spaces such as a closet.

It is a further object of the present invention to provide a back stimulation apparatus that contributes to the rehabilitation of the back by strengthening the supportive muscles when used properly.

It is a further object of the present invention to provide a back stimulation apparatus that will have a smooth operation on most surfaces, while having a means for increasing resistance to glide for rehabilitation purposes.

It is a further object of the present invention to provide a back stimulation apparatus that will comfortably support the head.

It is a further object of the present invention to provide a back stimulation apparatus that includes a sliding head rest that slides back and forth responsive to movement of the head of a user.

It is a further object of the present invention to provide a back stimulation apparatus that will produce additional resistance to glide if desired.

It is a further object of the present invention to provide a back stimulation apparatus that will optimize the massage affect by virtue of the flexibility of the roller axles.

It is a further object of the present invention to provide a back stimulation apparatus with an optional back pad for the increased comfort of the sensitive user.

It is a further object of the present invention to provide a back stimulation apparatus that can effectively stimulate difficult to reach, key trigger points by virtue of the round shape, variations in size, and strategic positioning and number of the roller elements.

Further objects of the present invention will be made apparent in the following Best Modes for Carrying Out Invention and the appended claims.

The foregoing objects are accomplished in one exemplary embodiment of the invention by a back stimulation apparatus that includes a main frame with a plurality of back roller balls. The back roller balls revolve on axles extending between the inner sides of the main frame. The stimulation apparatus further includes a head rest portion in slidable supporting connection with the main frame.

The invention is used by having the user lie down on the apparatus with their back resting on the back roller balls and their head resting on the sliding head rest. A pair of elastic bands connected to the main frame are attached to the ankles of the user. As the user alternatingly bends and extends his or her legs, the user slides back and forth over the back roller balls. In addition, the head rest slides back and forth responsive to the user's head moving back and forth with respect to the main frame.

BEST MODES FOR CARRYING OUT INVENTION

Figure 2:
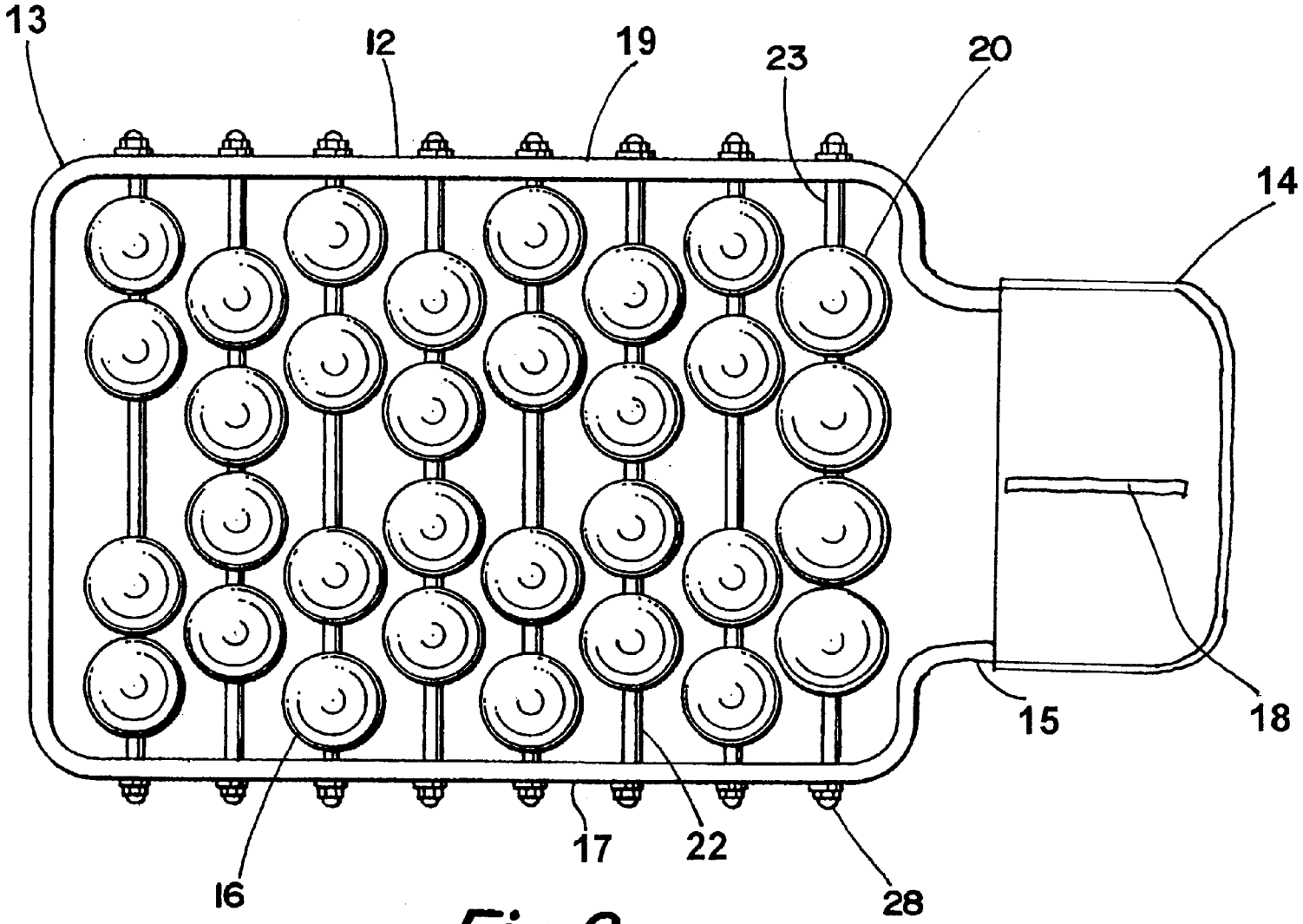
FIG. 2 shows a plan view of the invention with an exemplary placement of roller balls.

Referring now to the drawings and particularly to FIG. 2, there is shown therein, a top plan view of an exemplary embodiment of the present invention which includes a main frame 12. In this described embodiment, main frame 12 is slightly flexible for resilience, yet strong enough to resist major distortion over both the longitudinal and transverse axes.

Main frame 12 is somewhat rectangular in shape, having a foot end 13 and a head end 15. The foot end 13 has a large opening which houses a plurality of back roller balls 16. The back roller balls 16 are held in place on plurality of axles 22. The axles 22 are supported transversely within the main frame 12 by the lateral sections 17 and 19 of the main frame 12.

Figure 3:
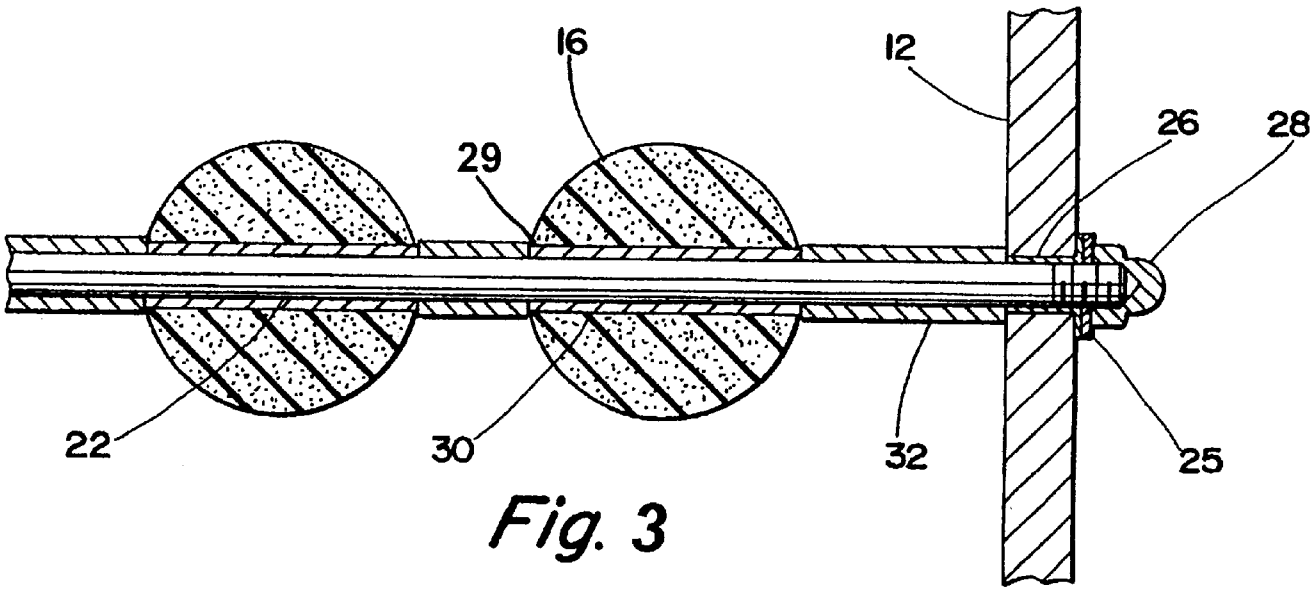
FIG. 3 shows an enlarged view of axle assembly consisting of bushings, roller balls, spacing tubes, axle, sleeves, flat washer and lock nut, and their relationship to the main frame.

As shown in FIG. 3, the axles are secured to the frame by a flat washer 25 and a lock nut 28 on the outside of main frame 12. A bushing 26 on each end of axle 22 assures free rotation while spacing tubes 32 maintain desired spacing of back roller balls 16 on axle 22.

Spacing tubes 32 are placed over axles 22 between the back roller balls 16 and between the back roller balls 16 and the main frame 12. Back roller ball spacing is controlled by the relative lengths of the spacing tubes 32. The back roller balls are placed as specifically as possible along each axle to correspond with reflex points of a user's body so that maximum trigger point stimulation is achieved.

Each back roller ball 16 has a centrally located bore 29 therethrough. A sleeve 30, is positioned inside the bore so that the ends of each sleeve 30 are flush with the outer perimeter of the back roller ball 16. Sleeve 30, has an inside diameter sufficiently large to enable the back roller ball 16 to rotate freely on axle 22. Spacing tube 32 has an inside diameter large enough to rotate freely on axle 22 and an outside diameter larger than that of sleeve 30. This described embodiment achieves both free and smooth rotation by both balls on axles, and by axles within frame. The present invention also encompasses any other means to achieve reduces rotational friction of the back roller balls 16. Other embodiments for example may use roller bearings.

Figure 1:
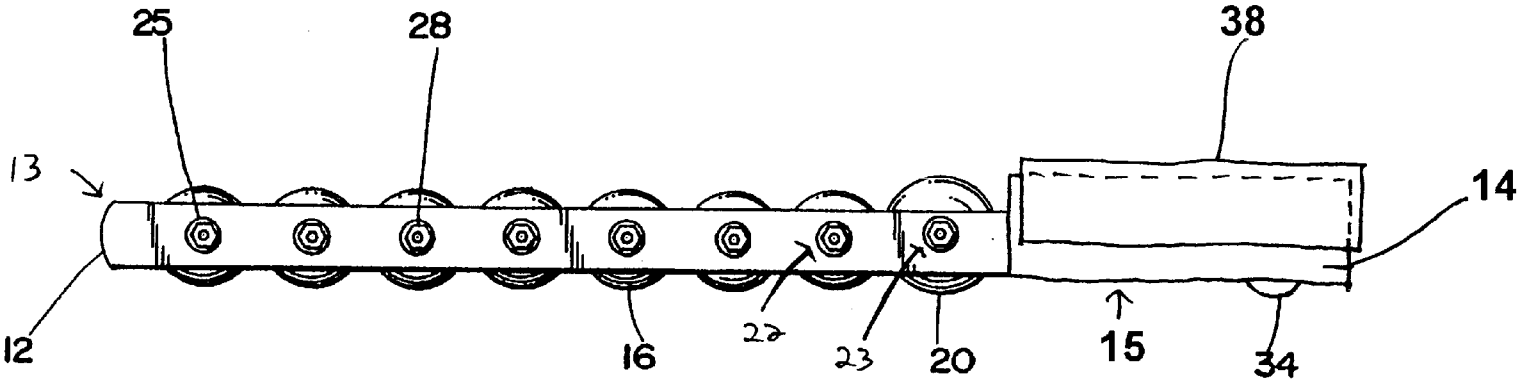
FIG. 1 shows a side elevational view of the main frame, head rest, head rest support and relationship of balls to frame.

Referring back to FIG. 2, the main frame 12 includes an upper back roller axle 23 located adjacent the head end 15. The upper back roller axle 23 includes a plurality of upper back roller balls 20 which are larger in diameter than the back roller balls 16. The upper back roller balls 20 are mounted on axle 23 in a similar manner as described for back roller balls 16. The increased relative size of upper roller axle balls 20 is important to insure proper contact with difficult to reach upper back trigger points. As shown in FIG. 1 of the exemplary embodiment the upper back roller axle 23 is mounted slightly higher than axles 22 in main frame 12 so that the upper back roller balls 20 lie flat on the floor with back roller balls 16 during use.

Figure 4:
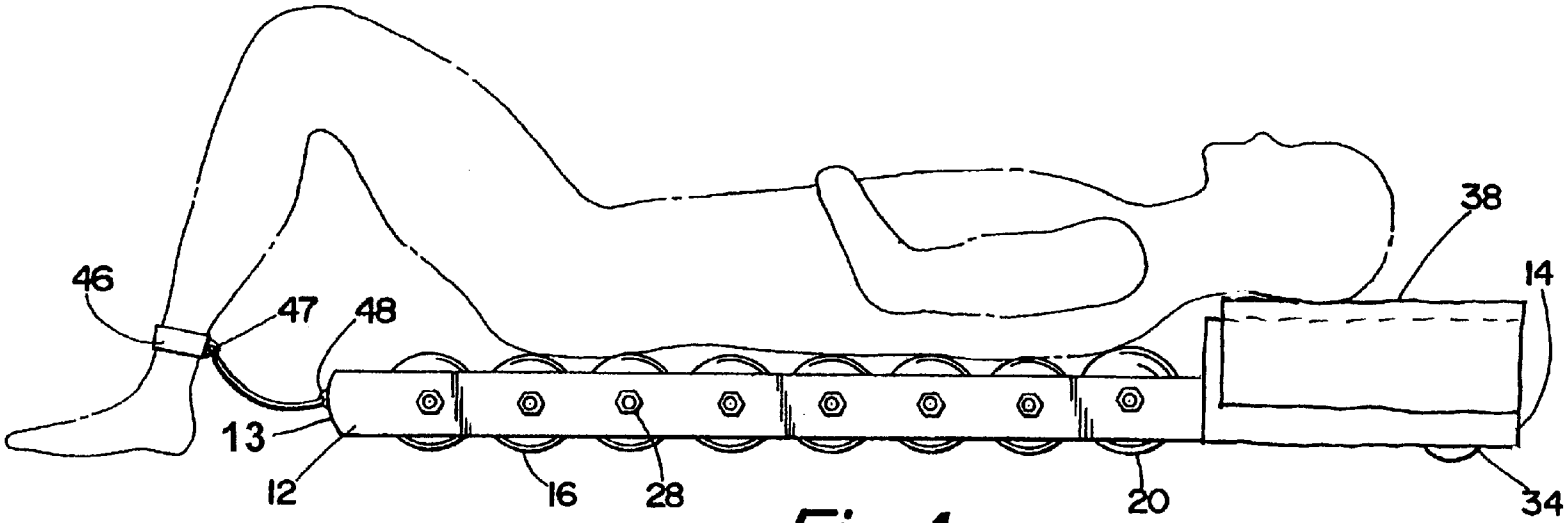
FIG. 4 shows an exemplary method of treatment with user's legs in flexed or starting position.

As shown in FIG. 4, the foot end 13 of the main frame 12 includes two optional resistance leg bands 46. These are fastened to frame 12 by means of an easily detachable, yet sturdy 48 hook or other convenient fastener. The resistance leg bands 46 include a clasp 47 that attaches to the ankles of the user. In the exemplary embodiment the leg bands 46 are elastic and may be adjusted in length for permitting users of different height equal rehabilitation capabilities.

Figure 6:
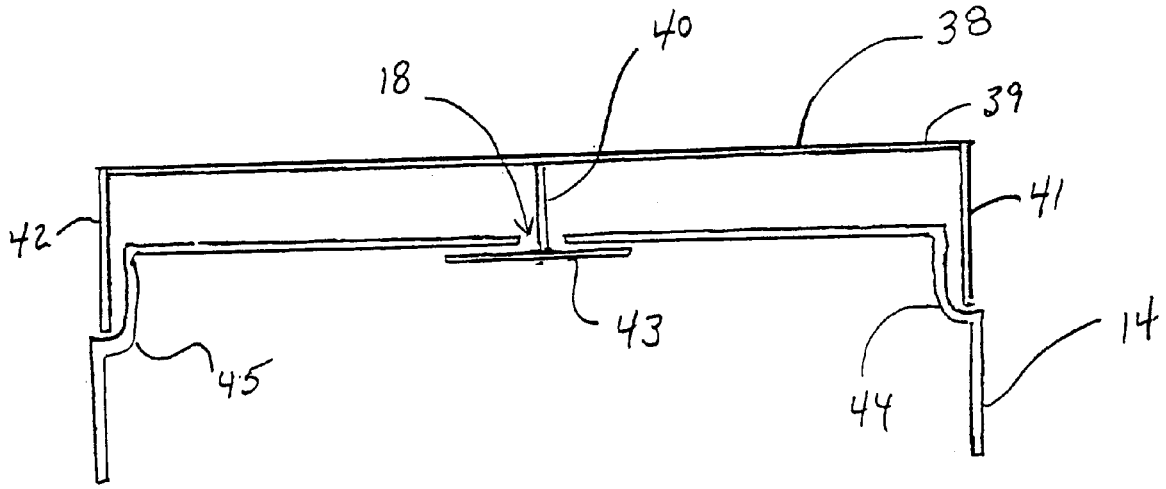
FIG. 6 shows an exemplary cross-sectional view of the head rest, head rest support, retainer and groove.

As shown in FIG. 1, the present invention further includes a head rest 38 that is in sliding supporting connection with the head end 15 of the main frame 12. In the exemplary embodiment, the head end 15 of the main frame 12 includes a head rest support 14. The head rest 38 is designed to slide back on forth with respect to the head rest support 14. As shown in FIG. 2, an exemplary embodiment of the head rest support 14 includes a slot 18 approximately at the centerline of main frame 12. As shown in FIG. 6, the head rest 38 has a top 39 and left and right sides 41 and 42.

The head rest support 14 includes left and right shoulders 44 and 45 to accommodate head rest sides 41 and 42. Sides 41 and 42 are approximately perpendicular to top 39 and are sized to ride on shoulders 44 and 45 as head rest 38 is moved longitudinally with respect to head rest support 14.

Figure 8:
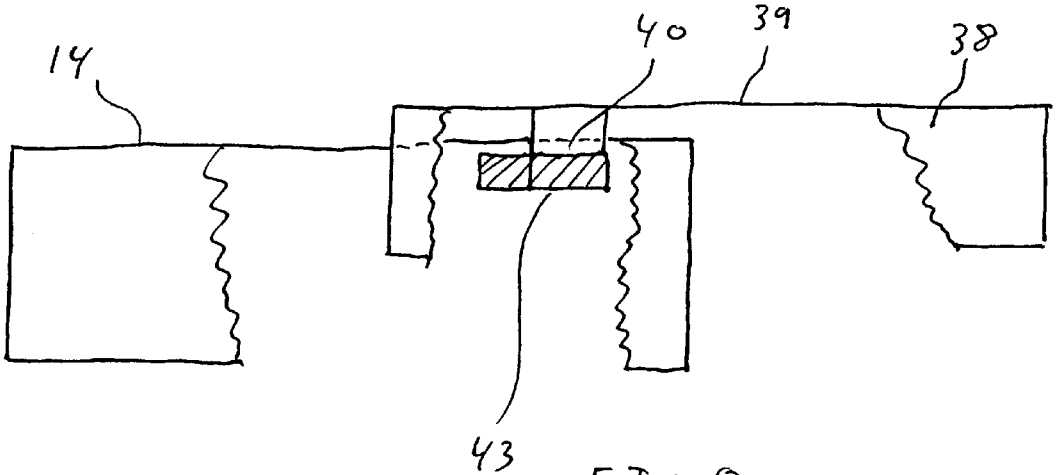
FIG. 8 shows a partial cut away side view of the head rest extended from the head rest support and further showing the head rest retainer.
Figure 11:
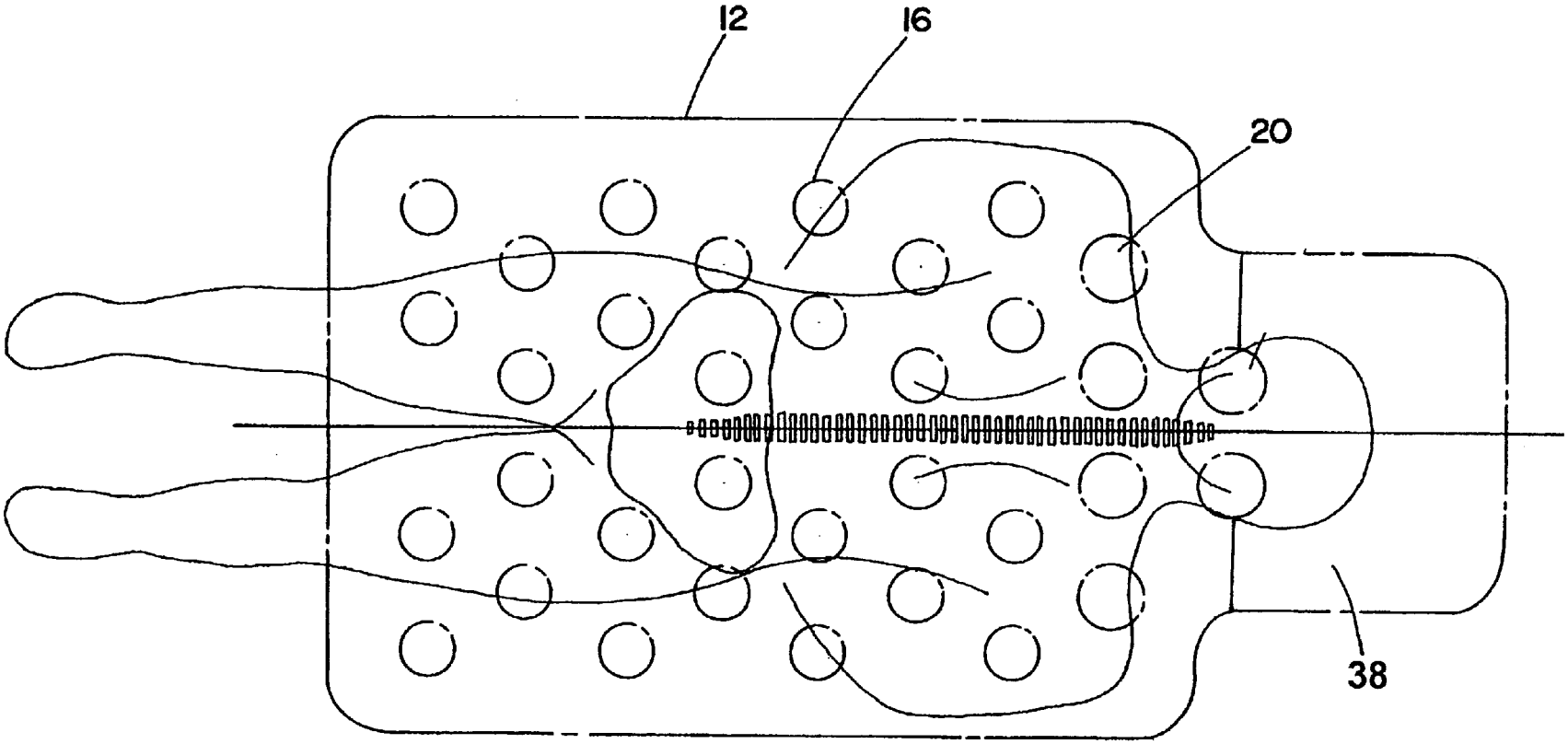
FIG. 11 shows body contact points of roller balls in exemplary positions.

The head rest further includes a flange 40 and retainer 43. Flange 40 extends downwardly from the bottom side of top 39 and is attached thereto. Retainer 43 is attached to the end of flange 40. As shown in FIG. 8 the retainer 43 extends adjacent the head rest 38 approximately parallel with respect to top 39.

In the exemplary embodiment flange 40 moves freely in slot 18 and sides 41 and 42 move freely on shoulders 44 and 45. This configuration enables a user's head that is resting on the head rest to slide the head rest in a reciprocating motion responsive to the back and forth movement of the user's head.

Figure 12:
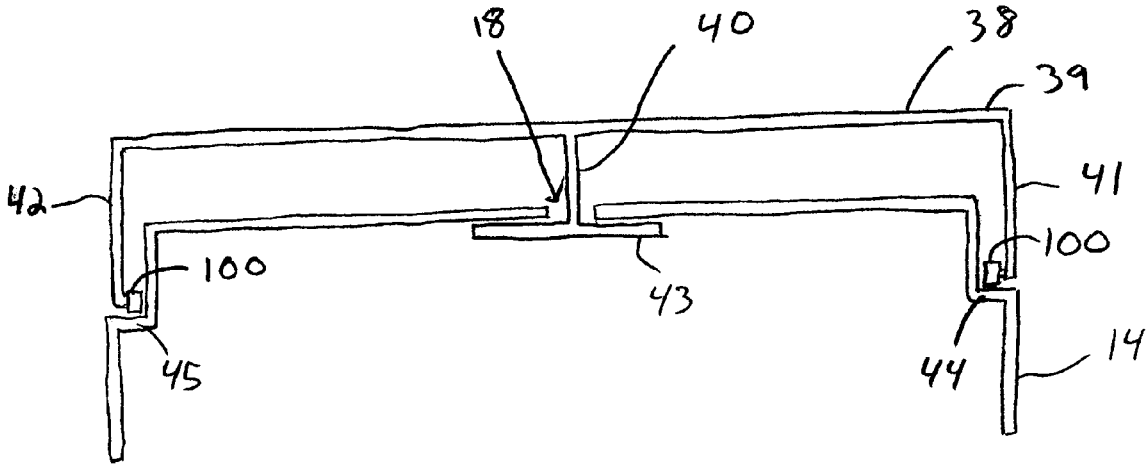
FIG. 12 shows an exemplary cross-sectional view of the head rest, head rest support, retainer, groove, and roller elements.

The present invention encompasses other configurations of a slidable head rest as well. For example as shown in FIG. 12 an alternative head rest and head rest support may include roller elements 100, tracks, belts or any other friction reducing elements and guide elements that are operative to enable a head rest to slide back and forth with respect to the main frame.

Figure 7:
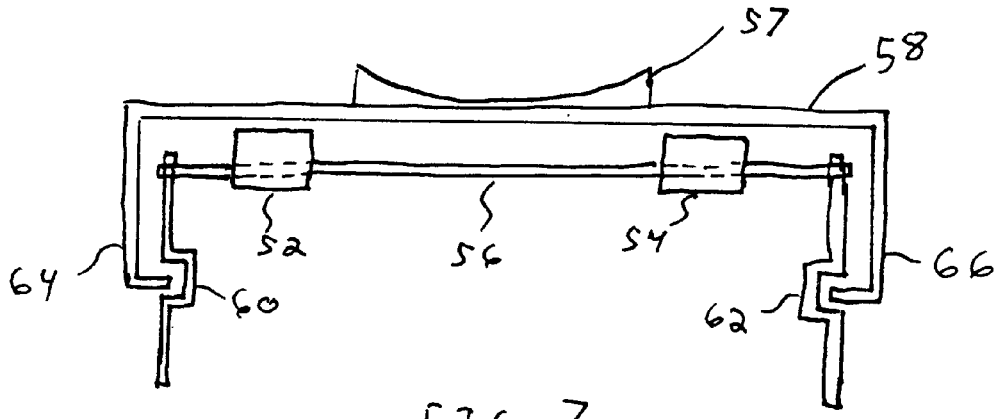
FIG. 7 shows a cross-sectional view of an alternative embodiment of the head rest and head rest support.

FIG. 7, shows an alternative exemplary embodiment of the head rest 58 where the head rest support 56 includes roller elements 54 and 52. These roller element 54 and 52 both support the head rest 58 and facilitate smooth sliding of the head rest 58 along the head rest support 14. In this described exemplary embodiment the head rest support 56 includes channels 60 and 62 which both retain and guide the L shaped retainer sides 64 and 66 of the head rest 58 as the head rest reciprocates. FIG. 7 also shows an exemplary head rest pad 57 which is operative to make the head rest more comfortable.

In addition, alternative embodiments of the head rest my include an adjustable frictional resistance. Such an adjustable resistence may be introduced by adjusting the thicknesses or materials of flange 40, sides 41 and 42, and shoulders 44 and 45, or by an adjustable a drag means such as wheels, springs, bands or other well known means for retarding movement. The increases resistance to sliding between the head rest and the head rest support enables the user to exercise neck muscles while using the device to stimulate the back. Also, the increased resistence results in additional intersegmental traction involving the neck, when the rate of movement of head rest 38, and the head of the user, is slower than the movement of the shoulders and back of the user.

To limit the head of the user from slipping off of the head rest, the head rest top 39 can be configured to firmly hold the head of the user. As shown in FIG. 7, this can be achieved with head rest pad 57 that has a contoured shape which corresponds to the curvature of a user's head. In other exemplary embodiments the head rest can include straps or other head guards which are operative to hold a user's head in place on the head rest as the apparatus is used.

Figure 10:
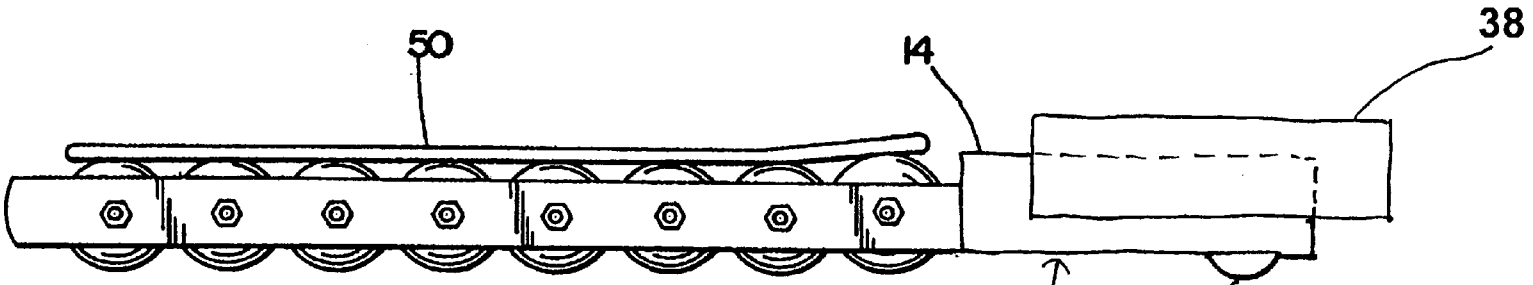
FIG. 10 is similar to FIG. 1 but shows the head rest partially extended from the head rest support, with consideration given to alternative placement in longitudinal aids.
Figure 9:
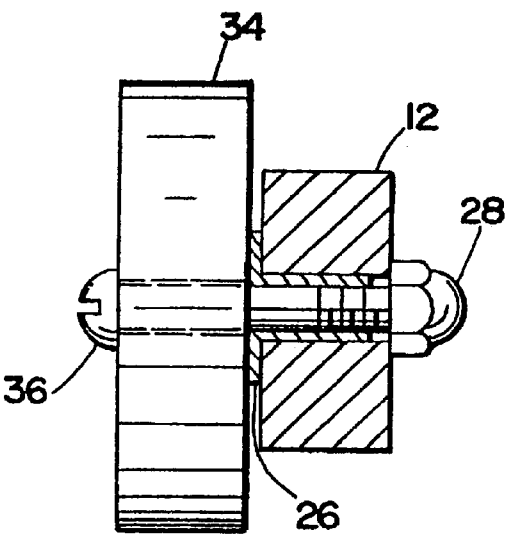
FIG. 9 shows tension adjusting screw controlling resistance of head rest support wheel.

As shown in FIG. 10, the head end 15 further includes one or more head rest support wheels 34. The head rest support wheel 34 is attached to each side of the head end of main frame 12 and is operative to support the weight of the head and neck during use of the invention. This permits smooth movement of the apparatus over a floor or other operating surface. As shown in FIG. 9, head rest support wheel 34 is fastened to main frame 12 by tension adjusting screw 36, which controls ease of glide during use by increasing or reducing friction. Referring back to FIG. 10, the apparatus includes an optional back pad 50. For users with sensitive backs, back pad 50 can be used to decrease pressure of roller balls on the back.

From the description above a number of advantages of the present invention become evident:

a) The number, relative size, shape, and placement of the foam rubber balls improves accuracy and completeness of stimulation of back muscle trigger points over previous self massage inventions.

b) The invention is compact and light-weight, and can easily be produced at a low cost from readily available materials.

c) Smooth action and durability are assured by the strategic placement of sleeves and axles.

d) Additional massage action is provided by longitudinal movement of flexible axles used for the back rollers.

e) A user's head is more comfortably supported during use of the apparatus.

f) Additional exercise and/or intersegmental traction involving the neck can be achieved.

Figure 5:
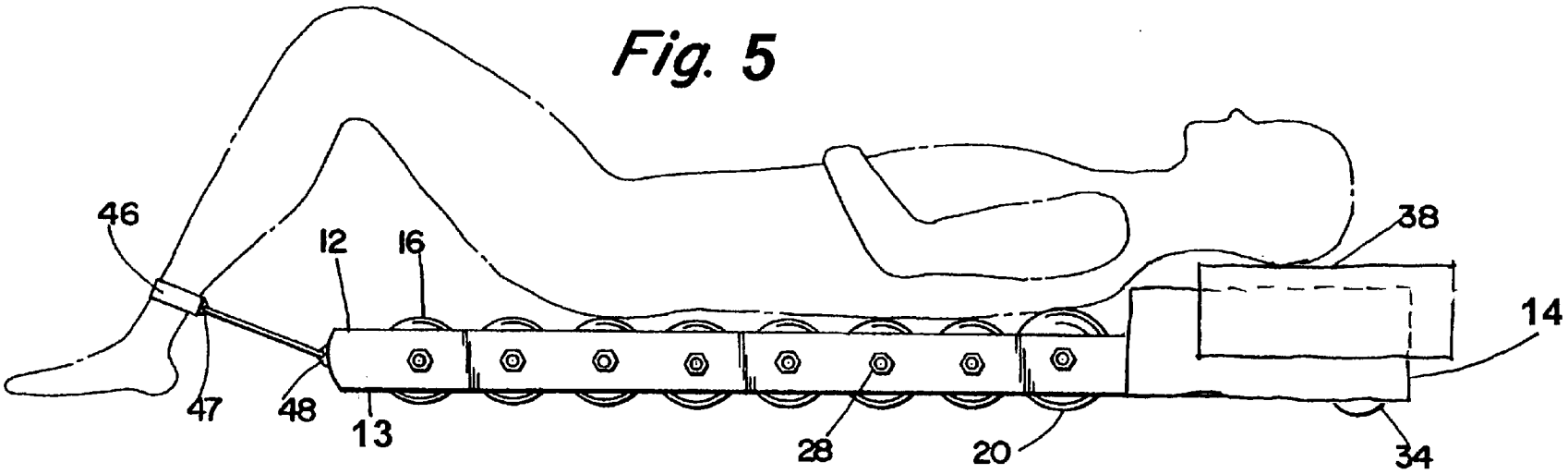
FIG. 5 shows user in finish position after completion of first movement in treatment, legs extended.

Exemplary methods for using this invention are illustrated in FIGS. 4 and 5. By lying his or her back on the roller balls 16, the user feels multiple points of pressure on muscles and spinal structures. As shown in FIG. 4 with the legs in a bent position and the feet placed flat on the floor, the lumbar spine is automatically flattened against roller balls 16, increasing contact area. In this position the upper back of a user contacts the upper back roller balls 20 in such a way as to cause pressure on key trigger points located there. In addition the head rests 38 comfortably supports a user's head.

As shown in FIG. 5, by slowly causing the legs to straighten the user pushes his or her body over the roller balls 16, 20. The legs are then flexed slowly causing the user and the device to move in the opposite direction, applying stimulation to various parts of the back.

Exercise is provided to the various supportive muscles of the back by the repetitious motion of the legs. This represents isotonic exercise. The opportunity to produce isometric exercise of the abdominal muscles is also present. This is accomplished simply by the user holding his or her head up during use. Resistance to leg extension can be increased by use of optional resistance leg bands 46. This accounts for much of the rehabilitation effect.

One of the advantages of the present invention, is that while the user is enjoying an invigorating back and neck massage the user is also exercising various muscle groups. By using multiple balls for the stimulation effect, the weight of the user is more widely dispersed, allowing a softer ball to be used. Also multiple balls enable the stimulation effect to be focused more specifically on a wide distribution of trigger points. In addition, the open space between the balls creates effective intersegmental traction on the joints of the spine and back.

Accordingly, the reader will see that proper use of this invention will produce a full back massage, intersegmental traction of the spine and associated joints and stimulation of a multitude of trigger points, and active rehabilitation of key muscles with little noticeable effort and with increased comfort for the head of the user.

Furthermore the present invention had the additional advantages of being light weight and has a compact design which permits ease of storage. The apparatus has smooth action and durability and can be built with readily available components which decrease its cost. The present invention has advantages of versatility for different treatments at once and fulfills a need in modern society in helping reduce the cost and occurrence of back pain. Further, the present invention has substantial utilities for those tens of millions of people suffering with back pain. Thus the back stimulation apparatus achieves the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

For example the foam rubber roller balls can be smooth, or have a roughened surface to produce more friction on the back of the user. The foam rubber balls are preferably of a medium soft density, but variations in density may be used. Different materials might be used for bushings and sleeves and other elements of the present invention. The overall shape of the main frame might also be changed for appearance purposes.

In the following claims any feature described as a means for performing a function shall be construed as encompassing any means known to those skilled in the art to be capable of performing the recited function, and shall not be limited to the structures shown herein or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. A back stimulation device comprising:

a main frame having a head end and a foot end, wherein the foot end has sufficient size to accommodate a human body in the supine position, wherein the head end includes a head rest support, wherein the head rest support includes a groove;

a plurality of axles transversely mounted within the main frame;

a plurality of roller balls in rotating supporting connection with the axles;

a head rest in sliding supporting connection with the head end of the main frame, wherein the head rest includes a bottom face, wherein the bottom face includes a flange which extends through the groove of the head rest support, wherein movement of the head rest is limited by the flange sliding within the groove, wherein when the human body of a user rolls back and forth over the roller balls, the head rest is operative to slide in a reciprocating motion responsive to movement of the human head of the user.

2. The back stimulation device of claim 1, wherein the end of the flange includes a retainer, wherein the width of the retainer is wider than the groove, whereby the retainer limits the flange from being removed from the groove.

3. The back stimulation device of claim 2, wherein the head rest support includes two shoulders located on opposed sides of the head rest support and extending parallel to the groove, wherein the head rest includes two side portions located on opposed ends of the head rest and extending perpendicular to the bottom face, wherein the shoulders support the side portions and the downward force of the head rest as the head rest is moved longitudinally with respect to head rest support.

4. The back stimulation device of claim 3, wherein the side portions are in sliding supporting connection with the shoulder portions.

5. The back stimulation device of claim 3, wherein the side portions include a plurality of roller elements in rolling supporting connection with the shoulders of the head rest support.

6. The back stimulation device of claim 1, wherein the head rest includes a sliding portion, wherein the sliding portion rides on the head rest support in sliding supporting connection as the head rest is moved longitudinally with respect to head rest support.

7. The back stimulation device of claim 6, wherein the head rest support includes at least one channel, wherein the sliding portion includes a retainer portion which extends within the channel, wherein movement of the sliding portion is limited by movement of the retainer portion within the channel.

8. The back stimulation device of claim 6, wherein the head rest support includes at least one roller element, wherein the sliding portion rides on the roller element.

9. The back stimulation device of claim 6, wherein the sliding portion includes at least one roller element, wherein the roller element rides on the head rest support.

10. The back stimulation device of claim 1, wherein the head rest includes a top face, wherein the top face includes a layer of padding.

11. The back stimulation device of claim 10, wherein the layer of padding has a shape which corresponds to the curvature of a human head.

12. The back stimulation device of claim 11, wherein the top face includes a head support, wherein the head support is operative to hold the human head in engagement with the head rest, whereby the head support limits a human head from slipping off of the head rest when the apparatus is in use.

13. The back stimulation device of claim 1, further comprising an adjustable resistance element, wherein the adjustable resistance element is operative to adjust the amount of force necessary to slide the head rest with respect to the head rest support.

14. The back stimulation device of claim 13 wherein the adjustable resistence element includes a spring between the head rest support and the head rest.

15. The back stimulation device of claim 13 wherein the adjustable resistence element includes a friction imparting element between the head rest and head rest support.

16. The back stimulation device of claim 1, further comprising at least one leg band in operative connection with the foot end of the main frame.

17. A back stimulation device comprising:

a main frame having a head end and a foot end, wherein the foot end has sufficient size to accommodate a human body in the supine position, wherein the head end includes a groove and a plurality of roller elements;

a plurality of axles transversely mounted within the main frame;

a plurality of roller balls in rotating supporting connection with the axles; and a head rest in sliding supporting connection with the roller elements of the head end, wherein the head rest includes a flange which extends through the groove of the head end, wherein movement of the head rest is limited by the flange sliding within the groove, wherein when the human body of a user rolls back and forth over the roller balls, the head rest is operative to slide in a reciprocating motion responsive to movement of the human head of the user.

* * * * *